US005830628A

United States Patent [19]

Borst et al.

[11] Patent Number: 5,830,628

[45] **Date of Patent: *Nov. 3, 1998**

[54] COLOR PHOTOGRAPHIC RECORDING MATERIAL

[75] Inventors: Hans-Ulrich Borst, Elsdorf; Detlef Brennecke, Leichlingen; Ralf Büscher, Lohmar; Johannes Willsau, Leverkusen; Peter Bell, Köln, all of Germany

[73] Assignee: Agfa-Geuaert, Germany

[ * ] Notice: The term of this patent shall not extend beyond the expiration date of Pat. No. 5,599,657.

[21] Appl. No.: 677,524

[22] Filed: Jul. 10, 1996

[30] Foreign Application Priority Data

Jul. 20, 1995 [DE] Germany ..... 195 26 470.3

[51] Int. Cl.[6] ..... G03C 1/46

[52] U.S. Cl. ..... 430/506; 430/502; 430/503; 430/505; 430/543; 430/552; 430/553; 430/554; 430/555; 430/567

[58] Field of Search ..... 430/502, 503, 430/506, 543, 552, 553, 554, 555, 567, 505

[56] References Cited

U.S. PATENT DOCUMENTS 4,614,707 9/1986 Fujita et al. ..... 430/506
4,705,744 11/1987 Sasaki et al. ..... 430/505
4,751,174 6/1988 Toya ..... 430/506
5,571,663 11/1996 Hirai ..... 430/506

*Primary Examiner*—Geraldine Letscher
*Attorney, Agent, or Firm*—Connolly & Hutz

[57] ABSTRACT

A colour photographic silver halide material with at least two blue-sensitive, yellow-coupling silver halide emulsion layers of differing photographic sensitivity, at least two green-sensitive, magenta-coupling silver halide emulsions layers of differing photographic sensitivity and at least two red-sensitive, cyan-coupling silver halide emulsion layers of differing photographic sensitivity, at least one interlayer Z-1 below the lowermost red-sensitive silver halide emulsion layer and/or at least one interlayer Z-2 below the lowermost green-sensitive silver halide emulsion layer, in which material a coupler is additionally used in at least one silver halide emulsion layer, which coupler couples to yield a colour which is not complementary to the spectral sensitisation of the layer concerned, and Z-1 and/or Z-2 contain a silver halide emulsion which has tabular grains with an aspect ratio of >2, an average diameter of a sphere of equal volume of ≧0.3 μm and a diameter of a circle of equal projected surface area of the tabular grains of ≧0.3 μm, is distinguished by improved sensitivity and an improved sensitivity/grain ratio.

10 Claims, No Drawings

COLOR PHOTOGRAPHIC RECORDING MATERIAL

This invention relates to a colour photographic silver halide material with camera sensitivity, the sensitivity and sensitivity/grain ratio of which are improved.

The improvements are achieved by the combination of so-called false colour couplers in chromogenic layers and tabular silver halide emulsions in interlayers.

False colour couplers are defined as couplers which couple to yield a colour which does not correspond to the colour which is complementary to the spectral sensitivity of the silver halide emulsion together with which the false colour coupler is used.

The term false colour coupler thus does not relate to its chemical structure, but instead to its use.

It is known to use false colour couplers in chromogenic layers to improve colour reproduction in photographic films, conventionally in such a manner that a small quantity of a certain cyan coupler or a certain magenta coupler is used in a blue-sensitive silver halide emulsion layer in addition to the yellow coupler (EP 167 173). Furthermore, a small quantity of a certain cyan coupler may be used in the green-sensitive silver halide emulsion layer in addition to the magenta coupler.

Phenolic or naphtholic 4-equivalent couplers, i.e. couplers which are unsubstituted on the coupling site, are used as cyan false colour couplers. Cyan couplers with photographically active fugitive groups are also used. Pyrazolotriazole couplers are used as magenta false colour couplers.

Improvements in sensitivity or the sensitivity/grain ratio are not achieved using these couplers alone.

It has now surprisingly been found that sensitivity and the sensitivity/grain ratio in colour photographic materials with camera sensitivity may be improved if false colour couplers are used in certain layers and certain interlayers contain silver halide emulsions with tabular grains.

The present invention thus provides a colour photographic silver halide material with at least two blue-sensitive, yellow-coupling silver halide emulsion layers of differing photographic sensitivity, at least two green-sensitive, magenta-coupling silver halide emulsions layers of differing photographic sensitivity and at least two red-sensitive, cyan-coupling silver halide emulsion layers of differing photographic sensitivity, at least one interlayer Z-1 below the lowermost red-sensitive silver halide emulsion layer and/or at least one interlayer Z-2 below the lowermost green-sensitive silver halide emulsion layer, characterised in that a coupler is additionally used in at least one silver halide emulsion layer, which coupler couples to yield a colour which is not complementary to the spectral sensitisation of the layer concerned, and Z-1 and/or Z-2 contain a silver halide emulsion which has tabular grains with an aspect ratio of >2, an average diameter of a sphere of equal volume of $\geqq 0.3$ $\mu$m and a diameter of a circle of equal projected surface area of the tabular grains of $\geqq 0.3$ $\lambda$m.

The false colour coupler is preferably used in a highly sensitive layer.

In a preferred embodiment, a quantity of 10 to 50 mg/m$^2$ of a phenolic or naphtholic 2-equivalent cyan coupler having a photographically inactive elimination group is used and/or a quantity of 10 to 50 mg/m$^2$ of a pyrazolone magenta coupler is used in the blue-sensitive silver halide emulsion layer with the highest photographic sensitivity, or a quantity of 10 to 50 mg/m$^2$ of a phenolic or naphtholic 2-equivalent cyan coupler having a photographically inactive elimination group is used in the green-sensitive silver halide emulsion layer with the highest photographic sensitivity.

The pyrazolone magenta coupler used as a false colour coupler may be a 2- or 4-equivalent coupler. Of the 2-equivalent couplers, those with a thioaryl or pyrazolyl fugitive group are preferred.

The false colour pyrazolone magenta coupler is preferably a 4-equivalent coupler.

Preferred false colour cyan couplers are of the formulae I and II:

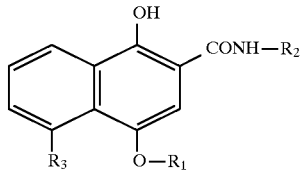

(I)

in which $R_1$ means unsubstituted or substituted alkyl or aryl, $R_2$ means unsubstituted or substituted alkyl and $R_3$ means hydrogen or NHCOO—$C_1$–$C_4$-alkyl;

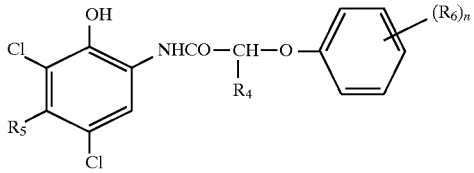

(II)

in which $R_4$, $R_5$ mean $C_1$–$C_4$ alkyl $R_6$ means $C_3$–$C_5$ alkyl, in particular branched, and n means 1 to 3.

Preferred false colour magenta couplers are of the formula (III)

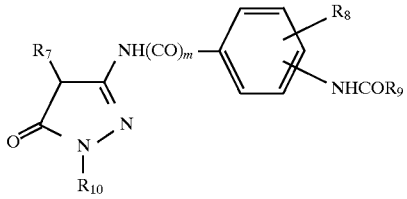

(III)

in which $R_7$ means hydrogen or a fugitive group, $R_8$ means hydrogen, $C_1$–$C_4$ alkoxy or halogen, $R_9$ means a ballast residue, $R_{10}$ means a di- to penta-substituted phenyl residue and m means 0 or 1.

$R_1$ is preferably —$CH_2$—$COHNR_{11}$ or

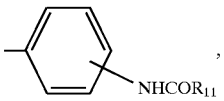

, wherein $R_{11}$ means $C_2$–$C_4$ alkyl optionally substituted by $C_1$–$C_4$ alkoxy or carboxy.

$R_2$ in particular has 16 to 24 C atoms and acts as a ballast residue. $R_2$ is preferably $C_{16}$–$C_{24}$ alkyl or phenoxy-substituted $C_1$–$C_6$ alkyl, wherein in the phenoxy residue is in particular further substituted by $C_3$–$C_5$ alkyl.

$R_3$ is preferably hydrogen.

$R_7$ is preferably hydrogen.

$R_9$ is preferably

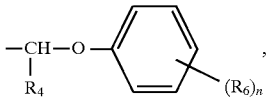

wherein $R_4$, $R_6$ and n have the above-stated meaning.

In particular, the false colour couplers are used in a quantity of 15 to 40 mg/m$^2$.

The false colour couplers preferably have a molecular weight of between 500 and 900 so that, on the one hand, they are non-diffusible, but, on the other hand, do not unnecessarily increase the total weight of the particular layer. Couplers with limited diffusibility, so-called smearing couplers, are also suitable.

Examples of false colour couplers to be used according to the invention are:

BG-1

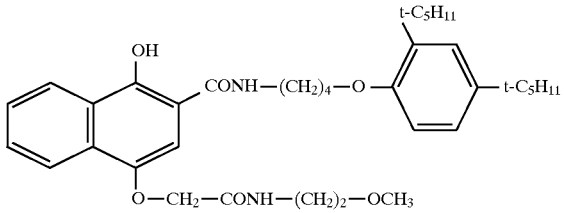

BG-2

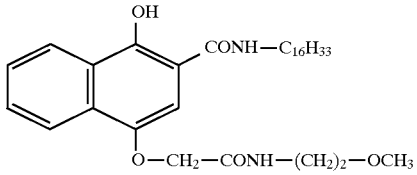

BG-3

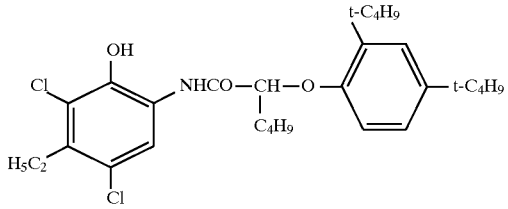

BG-4

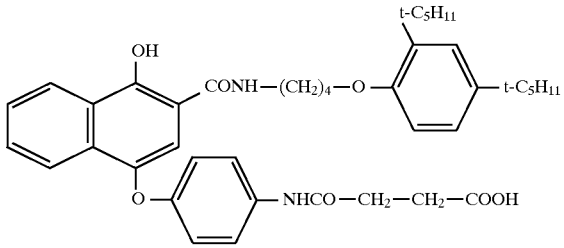

PP-1

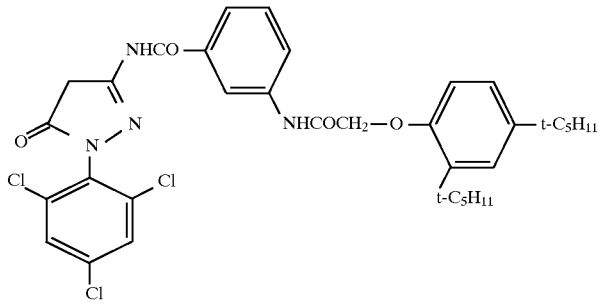

-continued

PP-2

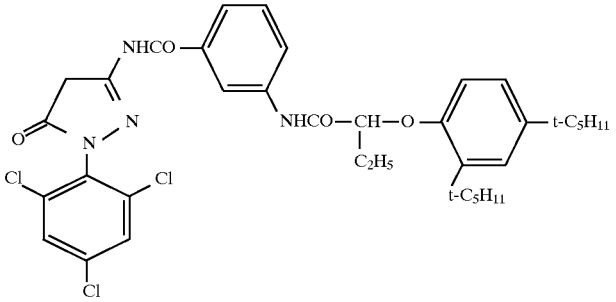

PP-3

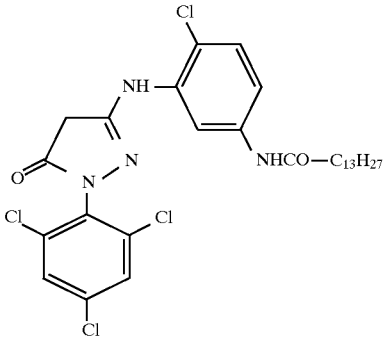

PP-4

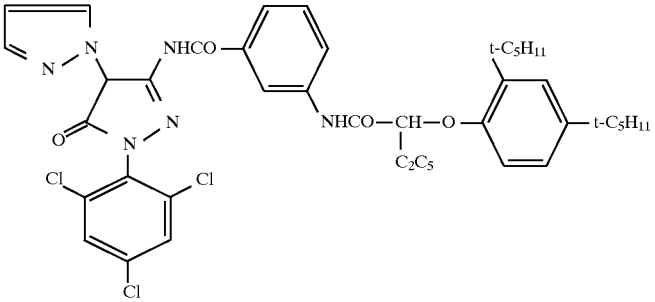

Preferably, in the material according to the invention, all the green-sensitive silver halide emulsion layers are arranged closer to the support than all the blue-sensitive silver halide emulsion layers and all the red-sensitive silver halide emulsion layers are arranged closer to the support than all the green-sensitive silver halide emulsion layers. A yellow filter layer is conventionally located between the blue-sensitive and green-sensitive silver halide emulsion layers. This filter layer may contain as its active constituent colloidal silver or a yellow dye, which it must be possible to decolour or rinse out. Such dyes are known from the literature.

Where the terms "above" and "below" are used, "below" means closer to the support and "above" means further from the support.

The material according to the invention preferably has a transparent support.

Suitable transparent supports for the production of colour photographic materials are, for example, films and sheet of semi-synthetic and synthetic polymers, such as cellulose nitrate, cellulose acetate, cellulose butyrate, polystyrene, polyvinyl chloride, polyethylene terephthalate, polyethylene naphthalate and polycarbonate. These supports may also be coloured black for light-shielding purposes. The surface of the support is generally subjected to a treatment in order to improve the adhesion of the photographic emulsion layer, for example corona discharge with subsequent application of a substrate layer. The reverse side of the support may be provided with a magnetic layer and an antistatic layer.

The tabular grains of interlayers Z-1 an Z-2 preferably constitute at least 50% of the projected surface area of the stated emulsion. The aspect ratio is preferably 4 to 15. The silver halide emulsions of interlayers Z-1 and Z-2 are in particular not spectrally sensitised and not ripened.

In particular, the material according to the invention has 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers, the material additionally containing interlayers Z-1 and Z-2 in the stated positions, a yellow filter layer between the green-sensitive and the blue-sensitive silver halide emulsion layers and optionally further interlayers, protective layers and outer layers.

The silver halide emulsion with tabular grains located in Z-1 and/or Z-2 in particular consists of 0 to 40 mol. % of AgI, 0 to 100 mol. % of AgCl and 0 to 100 mol. % of AgBr.

In a particularly preferred embodiment, the tabular grains consist of AgBr, have an average diameter of a sphere of equal volume of 0.45 to 0.55 $\mu$m, an average diameter of a circle of equal projected surface area of 0.79 to 1.02 $\mu$m, an average crystal thickness of 0.085 to 0.12 $\mu$m and an average aspect ratio of 8 to 10. The interlayer emulsion is used in a quantity corresponding to 0.1 to 2.0 g of $AgNO_3$ per $m^2$, preferably of 0.5 to 1.5 g of $AgNO_3/m^2$.

The essential constituents of the photographic emulsion layers are the binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

A colour photographic recording material for colour negative development was produced (layer structure 1A) by applying the following layers in the stated sequence onto a transparent cellulose triacetate film base. All stated quantities relate to 1 $m^2$. The quantity of silver applied is stated as the corresponding quantities of $AgNO_3$; the silver halides are stabilised with 0.5 g of 4-hydroxy-6-methyl-1,3,3a,7-tetraazaindene per mol of $AgNO_3$.

1st layer (anti-halo layer)

- 0.3 g of black colloidal silver
- 1.2 g of gelatine
- 0.4 g of UV absorber UV 1
- 0.02 g of tricresyl phosphate (TCP)

2nd layer (interlayer)

- 1.0 g of gelatine

3rd layer (low sensitivity red-sensitive layer)

- 2.7 g of $AgNO_3$ of a spectrally red-sensitised Ag(Br,I) emulsion with 4 mol. % iodide, average grain diameter 0.5 $\mu$m
- 2.0 g of gelatine
- 0.88 g of colourless coupler C-1
- 0.02 g of DIR coupler D-1
- 0.05 g of coloured coupler RC-1
- 0.07 g of coloured coupler YC-1
- 0.75 g of TCP 4th layer (high sensitivity red-sensitive layer)

- 2.2 g of $AgNO_3$ of spectrally red-sensitised Ag(Br,I) emulsion, 12 mol. % iodide, average grain diameter 1.0 $\mu$m
- 1.8 g of gelatine
- 0.19 g of colourless coupler C-2
- 0.17 g of TCP 5th layer (interlayer)

- 0.4 g of gelatine
- 0.15 g of white coupler W-1
- 0.06 g of A1 salt of aurintricarboxylic acid 6th layer (low sensitivity green-sensitive layer)

- 1.9 g of $AgNO_3$ of a spectrally green-sensitised Ag(Br,I) emulsion, 4 mol. % iodide, average grain diameter 0.35 $\mu$m
- 1.8 g of gelatine
- 0.54 g of colourless coupler M-1
- 0.24 g of DIR coupler D-1
- 0.065 g of coloured coupler YM-1
- 0.6 g of TCP 7th layer (high sensitivity green-sensitive layer)

- 1.25 g of $AgNO_3$ of a spectrally green-sensitised Ag(Br,I) emulsion, 9 mol. % iodide, average grain diameter 0.8 $\mu$m
- 1.1 g of gelatine
- 0.195 g of colourless coupler M-2
- 0.05 g of coloured coupler YM-2
- 0.245 g of TCP 8th layer (yellow filter layer)

- 0.09 g of yellow colloidal silver
- 0.25 g of gelatine
- 0.08 g of scavenger SC1
- 0.40 g of formaldehyde scavenger FF-1
- 0.08 g of TCP 9th layer (low sensitivity blue-sensitive layer)

0.9 g of $AgNO_3$ of a spectrally blue-sensitised Ag(Br,I) emulsion, 6 mol. % iodide, average grain diameter 0.6 μm 2.2 g of gelatine 1.1 g of colourless coupler Y-1

0.037g of DIR coupler D-1

1.14 g of TCP

10th layer (high sensitivity blue-sensitive layer)

0.6 g of $AgNO_3$ of a spectrally blue-sensitised Ag(Br,I) emulsion, 10 mol. % iodide, average grain diameter 1.2 μm 0.6 g of gelatine 0.2 g of colourless coupler Y-1

0.003 g of DIR coupler D-1

0.22 g of TCP

11th layer (micrate layer)

0.06 g of $AgNO_3$ of a micrate Ag(Br,I) emulsion, average grain diameter 0.06 μm, 0.5 mol. % iodide 1 g of gelatine 0.3 g of UV absorber UV-2

0.3 g of TCP

12th layer (protective & hardening layer)

0.25 g of gelatine 0.75 g of hardener of the formula

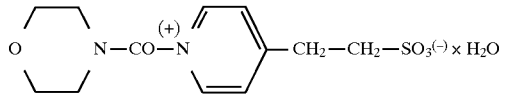

such that, once hardened, the total layer structure had a swelling factor of ≦3.5.

Substances used in example 1:

UV-1

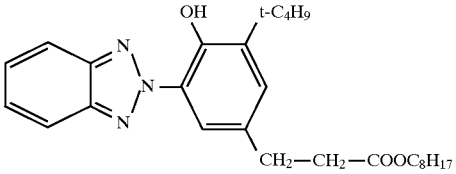

UV-2

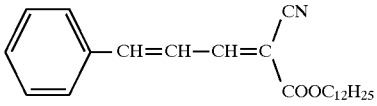

C-1

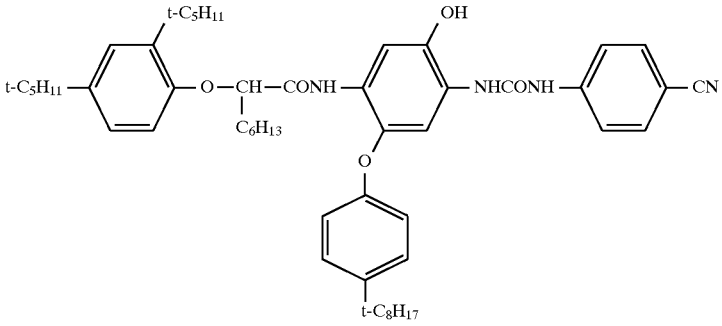

C-2

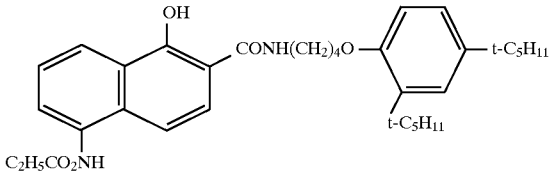

RC-1

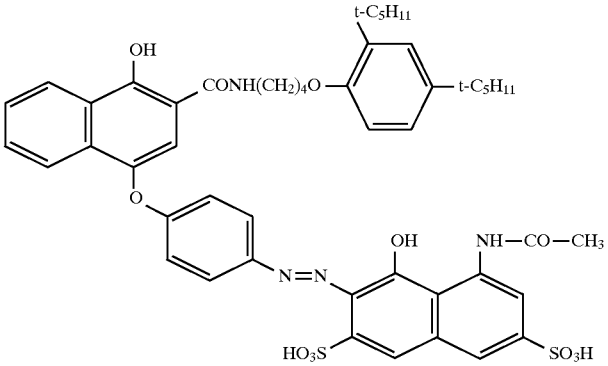

-continued
M-1
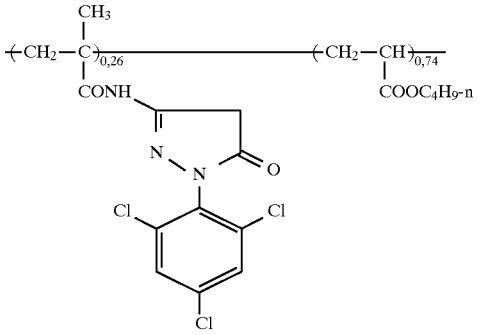
M-2
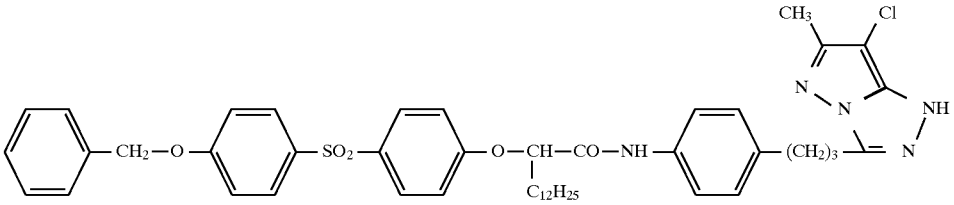
YM-1
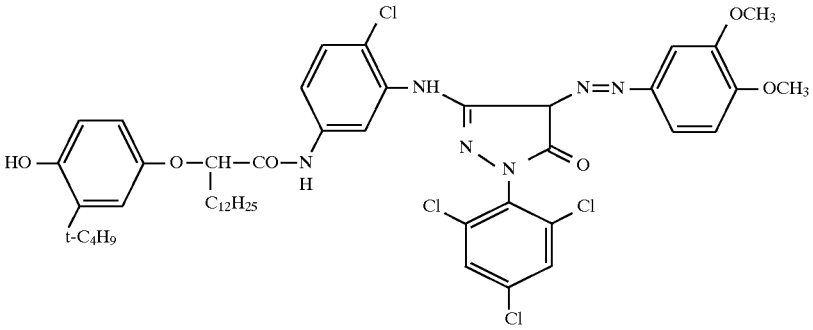
Y-1
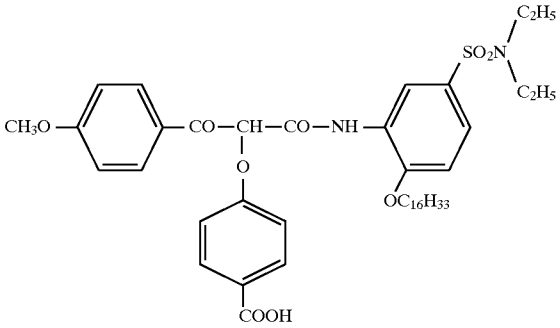
D-1
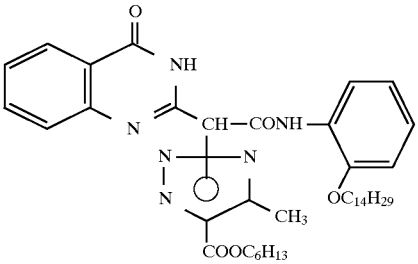

-continued
YC-1
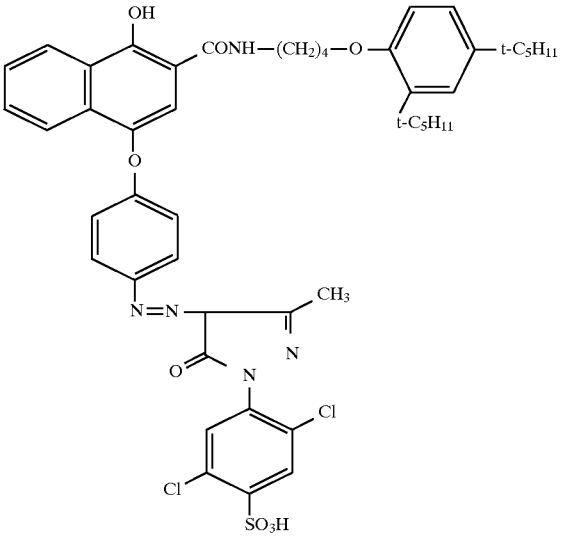
YM-2
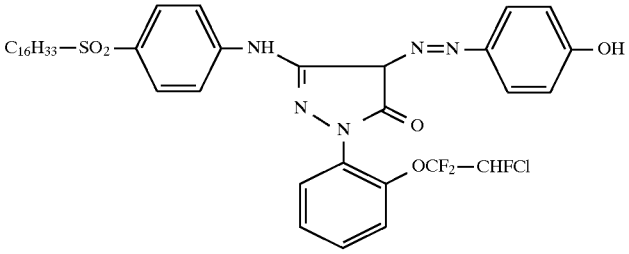
SC-1
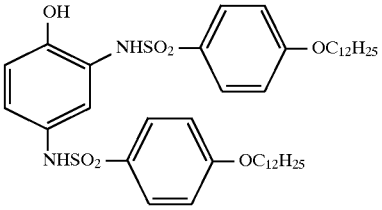
FF-1
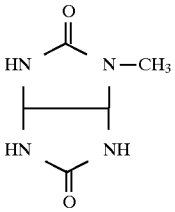
W-1
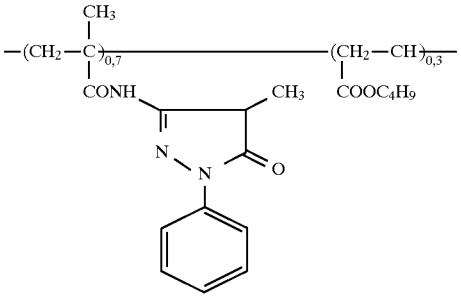

Once exposed with a grey wedge, the material is processed using a colour negative process described in *The British Journal of Photography* 1974, pages 597 and 598.

In layer structures 1B–1H, a silver halide emulsion was used in the 2nd layer and/or a quantity of 20 mg/m$^2$ of a cyan coupler was also added to the 10th layer. The compounds and results are shown in table 1.

TABLE 1

| Material | Emulsion in 2nd layer [0.5 g/m$^2$] | Coupler in 10th layer [20 mg/m$^2$] | Relative red sensitivity | Cyan grain*) | |
|---|---|---|---|---|---|
| 1A | — | — | 100 | 15.0 | Comparison |
| 1B | Em-1 | — | 100 | 15.5 | Comparison |
| 1C | Em-2 | — | 105 | 15.5 | Comparison |
| 1D | — | C-3 | 102 | 15.0 | Comparison |
| 1E | Em-1 | C-3 | 103 | 15.5 | Comparison |
| 1F | Em-2 | C-3 | 110 | 15.0 | Invention |
| 1G | Em-3 | C-3 | 112 | 15.5 | Invention |
| 1H | Em-3 | C-4 | 109 | 14.5 | Invention |

*)Grain (RMS) at density 0.4 above fog, values × 1000

Compounds additionally used in example 1:

Em-1

Micrate Ag(Br,I) emulsion, average grain diameter 0.07 μm, 0.5 mol. % iodide.

Em-2

Tabular unsensitised AgBr emulsion with the following characteristics:

More than 90% of the projected surface area is constituted by tabular crystals with an average diameter of a sphere of equal volume of 0.5 μm, an average diameter of a circle of equal projected surface area of 0.87 μm and an aspect ratio of 7.9.

Em-3

Tabular unsensitised AgBr emulsion with the following characteristics:

More than 95% of the projected surface area is constituted by tabular crystals with an average diameter of a sphere of equal volume of 0.55 μm, an average diameter of a circle of equal projected surface area of 0.92 μm and an aspect ratio of 7.0.

C-3

TABLE 1-continued

| Material | Emulsion in 2nd layer [0.5 g/m$^2$] | Coupler in 10th layer [20 mg/m$^2$] | Relative red sensitivity | Cyan grain*) |
|---|---|---|---|---|

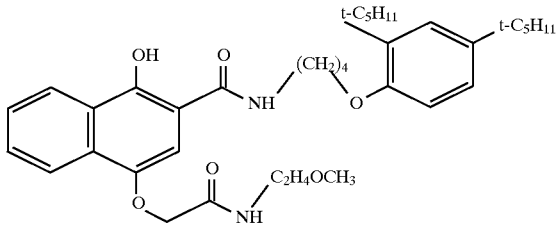

C-4

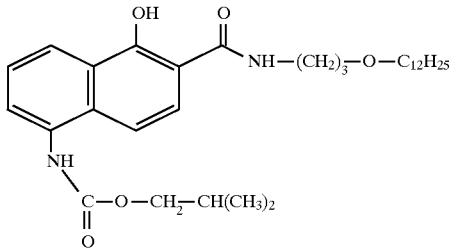

As may be seen, in the materials according to the invention, there is an improvement in the sensitivity/grain relationship for cyan accompanied by improved red sensitivity.

EXAMPLE 2

A quantity of 20 mg/m$^2$ of a magenta coupler was also added to the 10th layer in layer structures 2B–2G. The compounds and the results are shown in table 2.

TABLE 2

| Material | Emulsion in 5th layer [0.5 g/m$^2$] | Coupler in 10th layer [20 mg/m$^2$] | Relative green sensitivity | Magenta grain*) | |
|---|---|---|---|---|---|
| 2A = 1A | — | — | 100 | 14.0 | Comparison |
| 2B | Em-1 | — | 102 | 15.0 | Comparison |
| 2C | Em-2 | — | 103 | 15.0 | Comparison |
| 2D | — | M-3 | 103 | 14.0 | Comparison |
| 2E | Em-1 | M-3 | 103 | 15.5 | Comparison |
| 2F | Em-2 | M-3 | 109 | 14.0 | Invention |
| 2G | Em-2 | M-4 | 110 | 14.5 | Invention |

*)Grain (RMS) at density 0.4 above fog, values × 1000

Compounds additionally used in example 2:

M-3

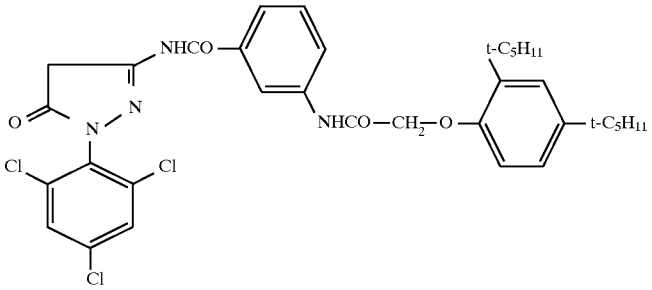

TABLE 2-continued

| Material | Emulsion in 5th layer [0.5 g/m$^2$] | Coupler in 10th layer [20 mg/m$^2$] | Relative green sensitivity | Magenta grain*) |
|---|---|---|---|---|
| M-4 | | | | |

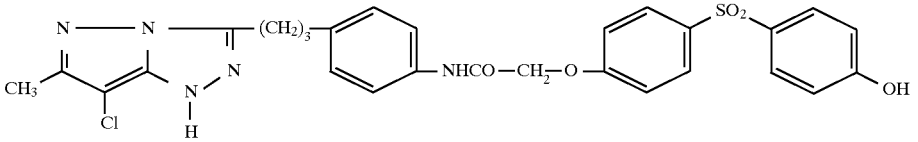

As may be seen, in the materials according to the invention, there is an improvement in the sensitivity/grain relationship for magenta accompanied by improved green sensitivity.

We claim:

1. A color photographic silver halide material which comprises at least two blue-sensitive, yellow-coupling silver halide emulsion layers of differing photographic sensitivity, at least two green-sensitive, magenta-coupling silver halide emulsions layers of differing photographic sensitivity and at least two red-sensitive, cyan-coupling silver halide emulsion layers of differing photographic sensitivity, at least one interlayer Z-1, which is closer to the support than the red-sensitive silver halide emulsion layer located closest to the support and/or at least one interlayer Z-2 which is closer to the support than the green-sensitive silver halide emulsion layer located closest to the support, wherein a coupler is additionally used in at least one silver halide emulsion layer, which coupler couples to yield a color which is not complementary to the spectral sensitization of the layer which contains said coupler, and Z-1 and/or Z-2 contain a silver halide emulsion which has tabular grains with an aspect ratio of >2, an average diameter of a sphere of equal volume of ≧0.3 $\mu$m and a diameter of a circle of equal projected surface area of the tabular grains of ≧0.3 $\mu$m.

2. The color photographic silver halide material according to claim 1, where in a quantity of 10 to 50 mg/m$^2$ of a phenolic or naphtholic 2-equivalent cyan coupler having a photographically inactive elimination group is used and/or a quantity of 10 to 50 mg/m$^2$ of a pyrazolone magenta coupler is used in the blue-sensitive silver halide emulsion layer with the highest photographic sensitivity, or a quantity of 10 to 50 mg/m$^2$ of a phenolic or naphtholic 2-equivalent cyan coupler having a photographically inactive elimination group is used in the green-sensitive silver halide emulsion layer with the highest photographic sensitivity.

3. The color photographic silver halide material according to claim 1, wherein the tabular grains of interlayers Z-1 and Z-2 constitute at least 50% of the projected surface area of the stated emulsion and the aspect ratio is 4 to 15.

4. The color photographic silver halide material according to claim 1, wherein the silver halide emulsion with the tabular grains located in Z-1 and/or Z-2 consists of 0 to 40 mol. % of AgI, 0 to 100 moo. % of AgCl and 0 to 100 mol. % of AgBr.

5. The color photographic silver halide material according to claim 1, wherein the silver halide emulsion used in Z-1 and/or Z-2 is used in a quantity corresponding to 0.1 to 2.0 g of $AgNO_3/m^2$.

6. The color photographic silver halide material according to claim 2, wherein said pyrazolone magenta coupler is a 4-equivalent coupler.

7. The color photographic silver halide material according to claim 1, wherein the coupler is selected from the group consisting of

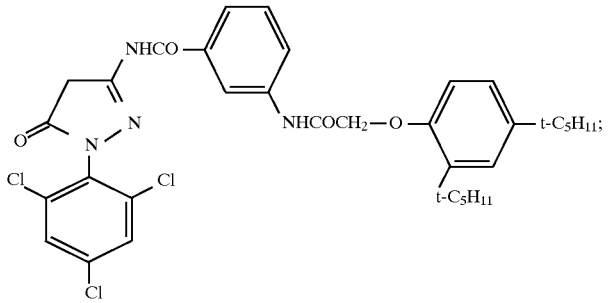

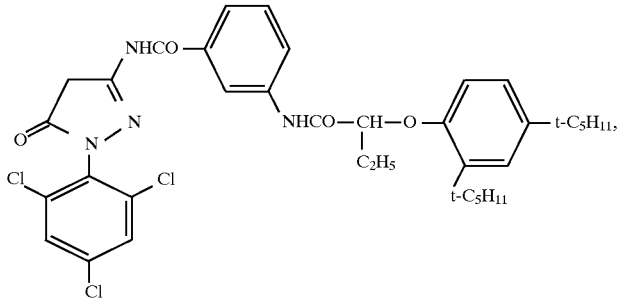

-continued
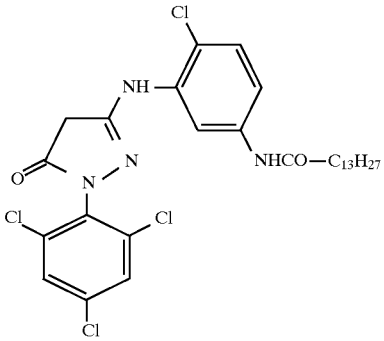
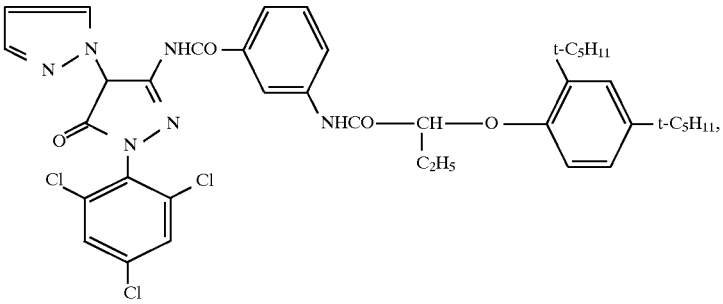
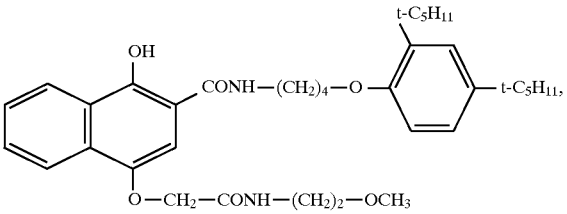
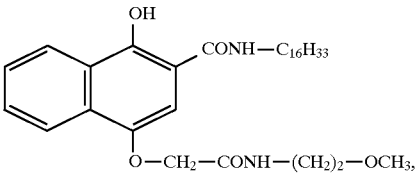
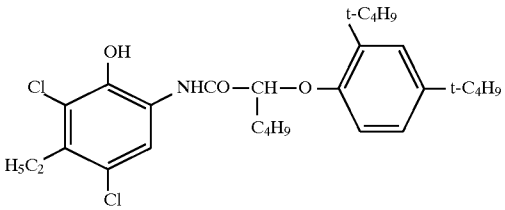
and
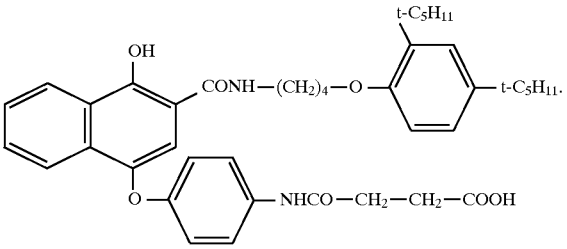

8. The color photographic silver halide material according to claim 4, wherein the tabular grains consist of AgBr which has an average diameter of sphere of equal volume of 0.45 to 0.55 $\mu$m, an average diameter of a circle of equal projected surface area of 0.79 to 1.02 $\mu$m, an average crystal thickness of 0.085 to 0.12 $\mu$m and an average aspect ratio of 8 to 10.

9. The color photographic silver halide material according to claim 5, wherein the silver halide emulsion used in Z-1 and/or Z-2 is used in a quantity corresponding to 0.5 to 1.5 g of $AgNO_3/m^2$.

10. The color photographic silver halide material according to claim 1, wherein the coupler is used in the highly sensitive layer.

* * * * *